United States Patent [19]

Johnson

[11] 4,151,695

[45] May 1, 1979

[54] MALE EYE FOR BRIDGE PANELS

[75] Inventor: John R. Johnson, Great Bookham, England

[73] Assignee: Thos. Storey (Engineers) Ltd., London, England

[21] Appl. No.: 821,634

[22] Filed: Aug. 4, 1977

[30] Foreign Application Priority Data

Aug. 13, 1976 [GB] United Kingdom ..... 33852/76

[51] Int. Cl.[2] ..... E01D 19/00

[52] U.S. Cl. ..... 52/726; 14/14

[58] Field of Search ..... 14/13, 14; 52/726; 52/645

[56] References Cited

U.S. PATENT DOCUMENTS 2,376,023 5/1945 Bailey ..... 14/13

FOREIGN PATENT DOCUMENTS 473948 7/1969 Switzerland ..... 14/14

1322011 7/1973 United Kingdom ..... 14/14

*Primary Examiner*—James L. Ridgill, Jr.

*Attorney, Agent, or Firm*—Wood, Herron & Evans

[57] ABSTRACT

A pre-fabricated bridge panel having a projecting "male eye" member in the form of an elongate block for connection to an adjacent panel. The upper surface of the inner end portion of the member slopes downwardly towards the inner end, this end portion being welded to a chord of the panel. The projecting end of the member has a hole formed therethrough transverse to the length of the block.

1 Claim, 7 Drawing Figures

14
34
II
22
II
24
26
20
28
12
2
6
4
10
16

14
26
20
32
12
2
18
28
30
6
16
8
4
22
18'
10
24
32

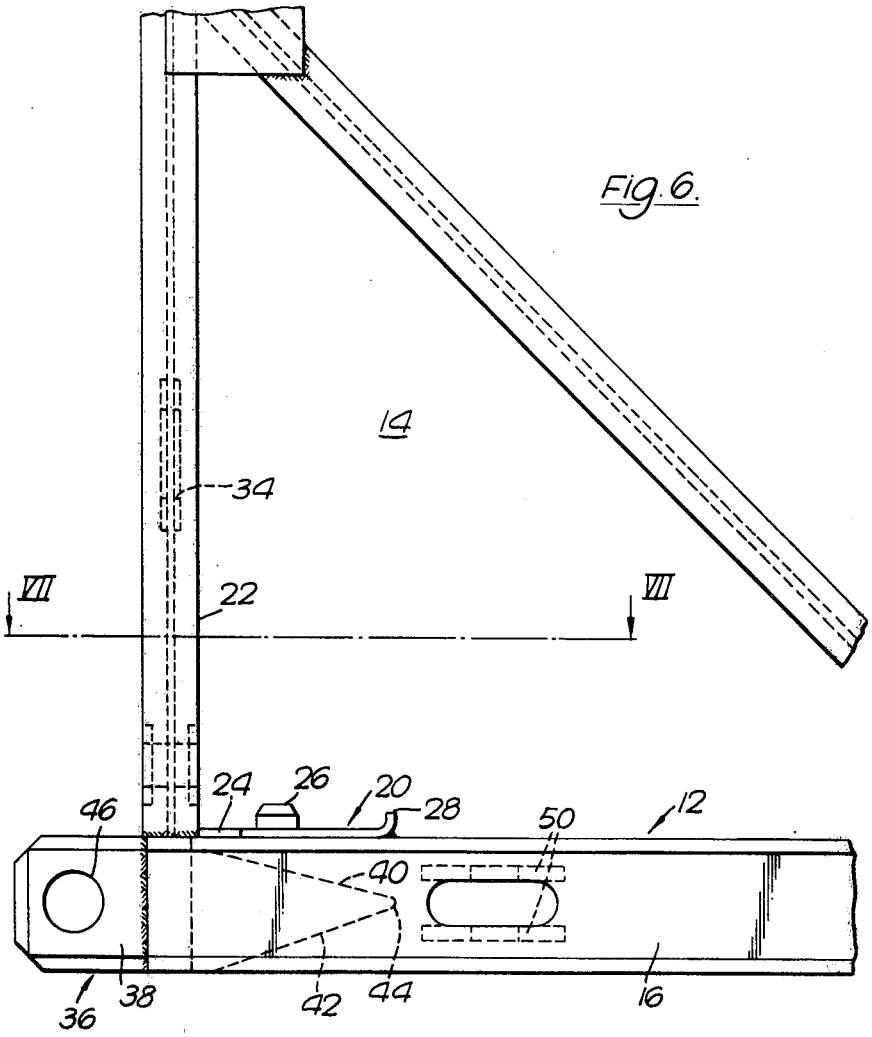
Fig. 6.
Fig. 7.
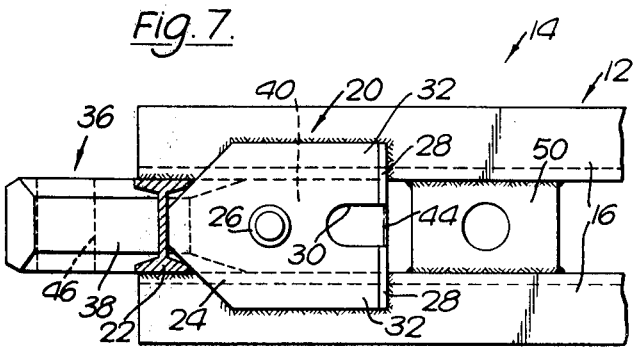

MALE EYE FOR BRIDGE PANELS

This invention relates to the inter-connection of pre-fabricated panels to form bridges.

Pre-fabricated panels of bridges are often interconnected by means of "male" eyes which extend from the top and bottom of one end of a panel and which are received in correspondingly positioned pairs of "female" eyes extending from an adjacent panel, the eyes being held together by members such as bolts or pins passing through holes in the eyes. Such "male" eyes have hitherto been in the form of elongate blocks, each block having a hole in one end and a "U" or "V" shaped cut-out extending from the other end. The edges of the block have been chamfered, at an angle 60°, to form surfaces which can be welded to two channel sections forming the upper or lower chord of a panel and between which the eye is fixed.

The "U" or "V" shaped cut-out, which is formed by a burning process, serves to reduce the heat capacity of the eye to aid the welding of the eye to the panel. Also, transom seatings may be provided on the lower chords of the panels. Some of these seatings are positioned adjacent to and on the inside of, vertical members at the ends of the panels, and take the form of brackets having an upstanding dowel generally in the centre of the bracket, on which a transom is located, and a "U" shaped cut-out at one side of the bracket to receive the head of a bolt of a transom clamp. When the transom clamp is fitted on the panel, the head of the bolt extends downwardly, underneath the transom seating, and between the channel sections forming the lower chord. Accordingly, another reason for the "U" or "V" shaped cut-out in the block forming the male eye is to provide a space underneath the transom seating to allow access to the head of the bolt.

Such "male" eyes suffer from the disadvantage that the welding of the eyes to the chords may not be as effective as is required. This is because the weld is within the 60° chamfer at the edges of the block, and such welds are known not to be as effective as, for example, a weld within a 90° angle. Also, the burning of the "U" or "V" shaped cut-out increases the cost of production of the eyes.

A pre-fabricated panel for a bridge, in accordance with the invention, has one or more male eye members connected to a chord, the members being in the form of an elongate block the upper surface of the inner end portion of the member sloping downwardly towards the inner end, a hole being formed in the projecting end transverse to the length of the block.

Preferably two opposite surfaces of the block slope towards the inner end of the block. The eye is positioned in the panel so that, in use, the hole extends in a horizontal direction and a sloping surface of the block is uppermost, the surface sloping downwardly toward the inner end of the block, so that, in use in Bailey Bridge panels, access is provided above the sloping surface for the head of a clamp bolt.

The block can be fixed to a chord of a panel by 90° fillet welds along the edges of the sloping surfaces, thus providing a more effective weld than that obtained from the weld on the chamferred edges of known male eyes. The effectiveness of the weld is further improved because of the improved heat flow characteristics of the block due to the fact that it is smaller at one end. The block forming the male eye member may be formed by forging, thus achieving advantages of strength and metallurgical structure, and the necessity of burning out a "U" or "V" shaped cut-out is obviated.

Fatigue tests have shown a significant increase in the fatigue life of panels in accordance with the invention when compared with panels having known male eye members.

The invention will now be further described by way of example with reference to the accompanying drawings, in which:

FIG. 6 is a side view of part of a Bailey Bridge panel incorporating a male eye in accordance with the invention, and FIG. 7 is a section along lines VII—VII of FIG. 6.

Figure 1:
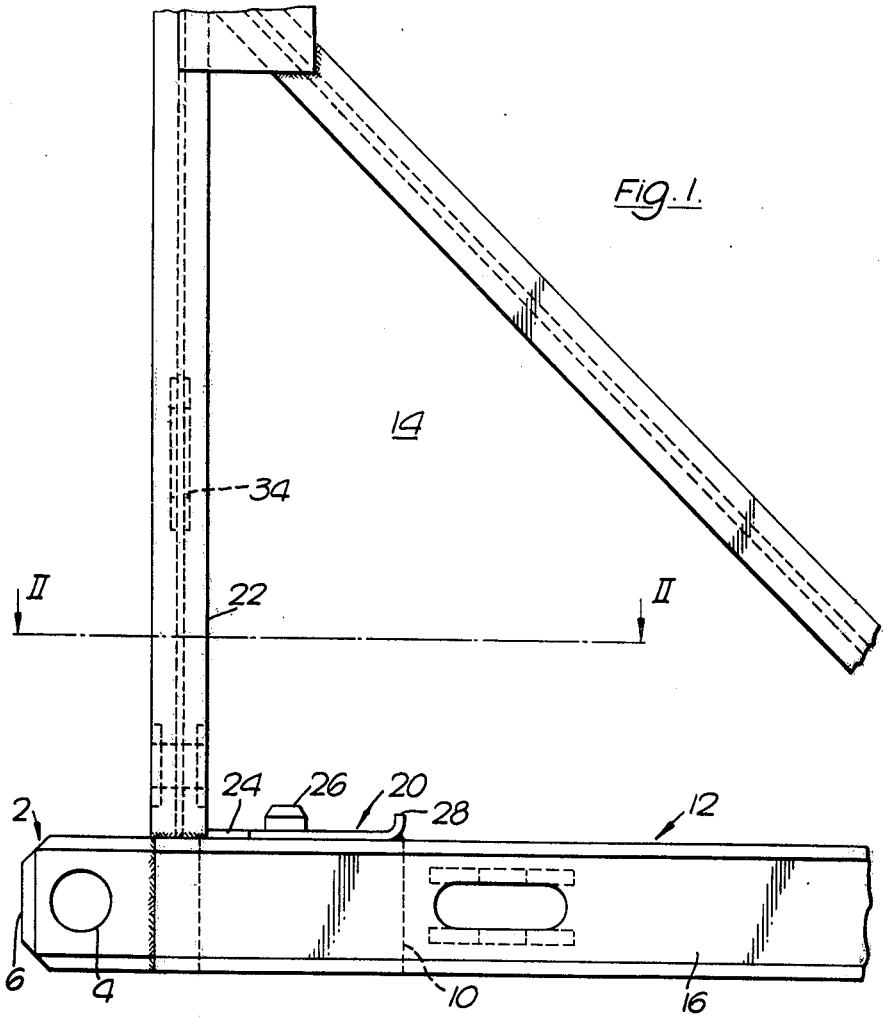
FIG. 1 is a side view of part of a Bailey Bridge panel incorporating a known male eye.
Figure 2:
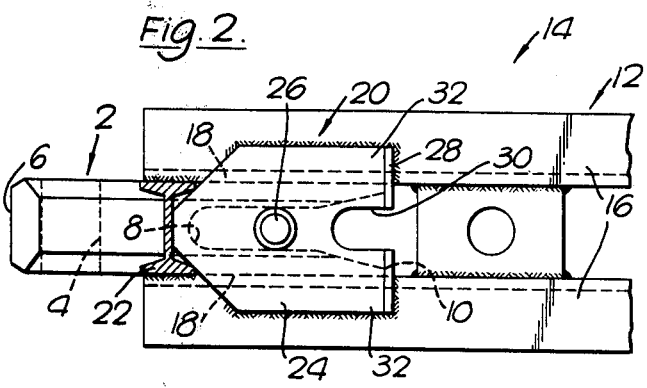
FIG. 2 is a section along line II—II of FIG. 1.

Referring to FIGS. 1 and 2, a conventional male eye generally indicated at 2 comprises an elongate block having a hole 4 at one end 6 and a "U" shaped cut-out 8 at the other end 10. The eye 2 is, in the embodiment illustrated, fixed to the lower chord 12 of a Bailey Bridge panel 14, with the end 6 incorporating the hole 4 projecting outwardly from the end of the chord 12.

The chord 12 comprises two parallel spaced U-section members 16 positioned back to back. The eye 2 is situated between these two members 16 and rigidly fixed in position by welding along the edges 18 of the eye 2, which are chamfered for this purpose, and at the end 10 of the eye 2.

In order to fix two panels together, the male eye 2 and another eye (not shown) extending outwardly from the top chord of the panel 14 are inserted into two female eyes extending from the end of another panel, and pins or bolts are inserted through the holes in the mating eyes to hold the panels together.

A transom seat 20 provided on the chord 10 and adjacent to and inside of the end of the end vertical 22 of the panel 14. The transom seat 20 comprises a plate 24 having an upstanding dowel 26, one edge 28 of the plate 24 being turned up and having a "U" shaped cut-out 30 forming two side by side flanges 32. When the bridge is erected a transom (not shown) may be placed on the seat 20 with a hole in the lower surface of the transom locating over the dowel 26, the edge of the transom being adjacent to the upturned edge 28.

The transom may then be secured in position by means of a clamp (not shown) having a nose which locates in a hole 34 in the end vertical 22 and a bolt which passes through the cut-out 30 and the head of which engages the lower sides of the flanges 32 when the clamp is tightened so as to secure the transom in position.

FIG. 2 shows clearly that the "U" shaped cut-out 8 of the male eye 2 provides access for the head of the clamp bolt.

Figure 3:
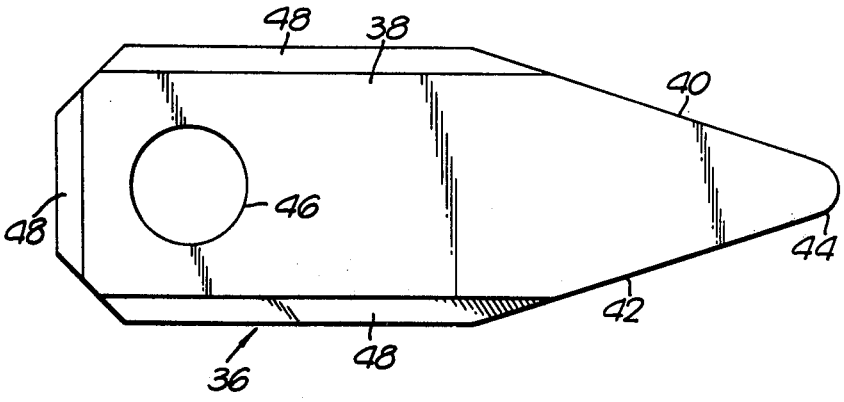
FIGS. 3, 4 and 5 are respectively side, plan and end views of a male eye in accordance with the invention.
Figure 4:
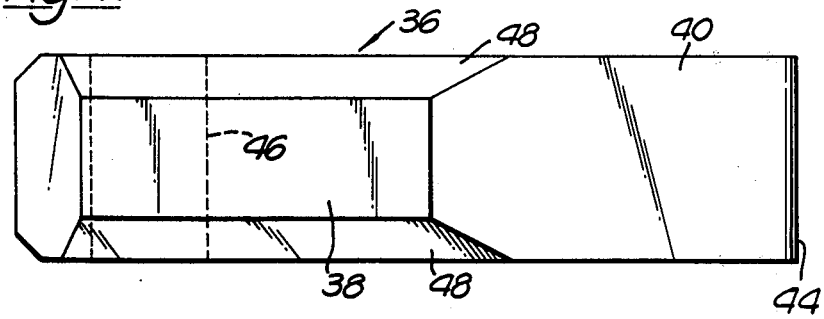
Figure 5:
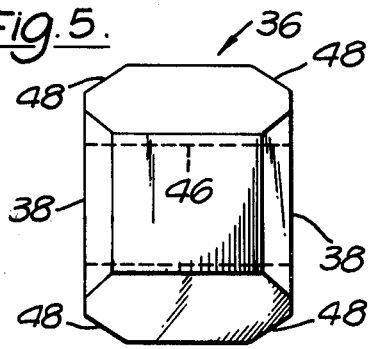

Referring now to FIGS. 3, 4 and 5, a male eye 36 in accordance with the invention comprises an elongate block 38, generally rectangular in cross-section, and having two opposite surfaces 40 and 42 which slope towards a point at the end 44 of the block 38. The eye may be formed by forging, after which a hole 46, for receiving a pin to interconnect the eye with a female eye, is drilled. The edges 48 of the block are chamferred.

The eye 36 is positioned in the lower chord 12 of the panel 14 as shown in FIGS. 6 and 7, with the hole 46 aligned horizontally and the sloping surface 40 of the block 38 positioned uppermost. The tapering of the block 38 towards its end 44 provides access for the insertion of the end of a clamp bolt in the cut-out 30 of the transom seat 20.

The eye 36 may be welded as shown along the edges of the sloping sides 40 and 42 by 90° fillet weld, thus providing a stronger weld than that obtained with the conventional eye 2 of the embodiment of FIGS. 1 and 2.

The tapering of the block 38 at its end 44 improves the heat flow characteristics of the block, causing better weld penetration between the block and the members 16 of the chord 12.

The male eye 36 may be used with advantage in bridge panels other than Bailey Bridge panels.

It may be advantageous to make the slotted member 50, which is provided to receive one end of a brace, from a single U-shaped plate, the sides of which are extended to contact the surfaces 40, 42 to which the ends of the plate are welded in order to improve the fatigue life of the unit.

I claim:

1. A pre-fabricated panel for a bridge, said panel comprising a chord member having a longitudinal axis, a male eye member connected to said chord member at one end thereof, said male eye member being in the form of an elongated block having an outer end portion extending beyond one end of said chord member and an inner end portion positioned against a side surface of said chord member, said outer end portion defining a hole oriented transverse to said longitudinal axis, and said inner end portion defining an upper surface sloping downwardly from the upper surface of said outer end portion, said downwardly sloping surface being angled relative to the longitudinal axis of said chord members, and a fillet weld extending along said downwardly sloping surface between said downwardly sloping surface and said chord member to aid in connecting said male eye member to said chord member, said upper end portion further defining a lower surface sloping upwardly from a lower surface of said outer end portion wherein the upper and lower surfaces of said inner end portion slope towards each other relative to said longitudinal axis, said surfaces cooperating to form a V-shaped inner end portion for said block when said block is viewed in a line of sight normal to said longitudinal axis, and said block being fixed to said chord member by 90° fillet welds extending along the edges of both said sloping surfaces.

* * * * *